US005547414A

United States Patent [19]

Ohmori

[11] Patent Number: 5,547,414

[45] Date of Patent: Aug. 20, 1996

[54] METHOD AND APPARATUS FOR GRINDING WITH ELECTROLYTIC DRESSING

[75] Inventor: Hitoshi Ohmori, Tokyo, Japan

[73] Assignee: Rikagaku Kenkyusho, Saitama-ken, Japan

[21] Appl. No.: 294,335

[22] Filed: Aug. 23, 1994

[30] Foreign Application Priority Data

Aug. 30, 1993 [JP] Japan ..... 5-213675

[51] Int. Cl.[6] ..... B24B 49/00

[52] U.S. Cl. ..... 451/21; 451/56; 451/8

[58] Field of Search ..... 451/21, 8, 11, 451/56

[56] References Cited

U.S. PATENT DOCUMENTS

| | | | |
|---|---|---|---|
| 3,641,714 | 2/1972 | Asano | 451/21 |
| 3,905,161 | 9/1975 | Tomita et al. | 451/450 |
| 4,945,888 | 8/1990 | Mushardt et al. | 451/11 |
| 5,088,239 | 2/1992 | Osman | 451/5 |
| 5,091,067 | 2/1992 | Ushiyama et al. | 204/129.46 |
| 5,108,561 | 4/1992 | Kuromatsu | 204/129.46 |
| 5,237,779 | 8/1993 | Ota | 451/5 |

*Primary Examiner*—Bruce M. Kisliuk
*Assistant Examiner*—Thomas W. Lynch
*Attorney, Agent, or Firm*—Griffin, Butler Whisenhunt & Kurtossy

[57] ABSTRACT

An apparatus for grinding a workpiece while electrolytically dressing an electrically conductive grinding wheel. The apparatus has an electrically conductive grinding wheel with a contact surface for contacting the workpiece, an electrode opposed to the grinding wheel and spaced a distance therefrom, a nozzle for supplying conductive fluid between the grinding wheel and the electrode, and a device for applying a voltage between the grinding wheel and the electrode. An eddy current sensor is arranged in proximity to the working surface of the grinding wheel for measuring the position of the grinding wheel in a non-contact manner. A grinding wheel controlling device is provided for controlling the position of the grinding wheel based on the values measured by the eddy current sensor. The apparatus can measure the dimensions of the grinding wheel during its grinding operation without being influenced by the grinding fluid and the nonconductive film formed on the wheel and can therefore efficiently carry out high accuracy grinding without a high degree of operator skill.

15 Claims, 5 Drawing Sheets

Measurement of Initial Deflection of Grinding Wheel and Influence of Grinding Fluid Change in Diameter of Grinding Wheel Due to Truing Change in Diameter of Grinding Wheel Due to Electrolytic Dressing Change in Diameter of Grinding Wheel Due to ELID Grinding Results of Measurement of Cross-Sectional Configuration of Grinding Wheel

METHOD AND APPARATUS FOR GRINDING WITH ELECTROLYTIC DRESSING

BACKGROUND OF THE INVENTION

1. Field of the Invention

The present invention relates to a method and an apparatus for grinding with electrolytic dressing, and more particularly to a method and an apparatus for grinding accompanied by electrolytic dressing of a metal bonded grinding wheel carried out along with in-process measurement of the dimensions of the grinding wheel.

2. Description of the Related Art

Japanese Laid-open Patent Publication No. 188266/1989 (Japanese Patent Application No. 12305/1988) filed by the same applicant as that of the present application discloses a method and an apparatus for electrolytically dressing a conductive grinding wheel. The conductive grinding wheel may be a metal bonded grinding wheel, for example, a cast iron fiber bonded diamond wheel, and the wheel is dressed by applying a voltage to the grinding wheel. This method and apparatus have been successfully applied to the mirror surface grinding of semiconductor material such as silicon wafers. In addition, the inventor of the present invention has developed a technique called "ELID grinding" (Electrolytic In-process Dressing) which was reported at a symposium held by The Institute of Physical and Chemical Research (RIKEN) of Saitamaken, Japan ("Recent trends in mirror surface grinding technology", May 5, 1991).

In the ELID grinding method, a workpiece is ground by applying a voltage between a conductive grinding wheel and an electrode while supplying conductive fluid between the wheel and the electrode. The wheel is then electrolytically dressed. The ELID apparatus comprises a conductive grinding wheel having a contact surface for contacting the workpiece, an electrode opposed to the grinding wheel and spaced a distance therefrom, a nozzle for supplying conductive fluid between the grinding wheel and the electrode, and a device (i.e., a power source and feeder) for applying a voltage between the grinding wheel and the electrode.

FIG. 7 (PRIOR ART) shows the mechanism of electrolytic dressing according to the ELID grinding method. During pre-dressing (See Portion (A) of FIG. 7), when grains protrude from the wheel, the electrical resistance between the wheel and the electrode is low so that the electric current between the wheel and the electrode is relatively high (5–10 A). Therefore, the bond material on the surface of the wheel is dissolved electrolytically, and the non-conductive diamond grains are exposed. After a number of grains have been exposed (Portion (B) of FIG. 7), an insulating or non-conductive film comprising iron oxide (Fe203) is formed on the surface of the grinding wheel so that the electric resistance of the wheel is then increased. As a consequence of the film formation, both the electric current and the dissolution of the bond material decrease, and the exposure of the grains is virtually completed. Under the condition shown in Portion (B) of FIG. 7, grinding with the wheel is started. As a result of grinding, insulating film and diamond grains are scraped off and removed while the workpiece is ground by the grinding wheel (Portion C of FIG. 7). When the grinding is continued (Portion (D) of FIG. 7), the insulating film is worn off the surface of the grinding wheel so that the electrical resistance of the wheel decreases and the electric current between the grinding wheel and the electrode increases. The dissolution of bond material thereafter increases, and the exposure of the grains is started again.

As mentioned above, during ELID grinding, the formation and removal of the insulation film occurs as shown in Portions (B) through (D) of FIG. 7, the dissolution of the bond material is regulated automatically and the exposure of the grains is also automatically controlled. The process shown in Portions (B) through (D) of FIG. 7 is hereinafter referred to as the "ELID cycle".

In the above-mentioned ELID grinding, since the grains are automatically exposed by the ELID cycle, choking of the wheel does not occur even if the grains are very fine. Thus, with ELID grinding an excellent ground surface having a mirror surface can be obtained by using very fine grains. Consequently, the ELID grinding method can maintain excellent grinding abrasiveness in a wide range of applications from high efficiency grinding to mirror surface grinding.

However, the nonconductive film formed on the surface of the grinding wheel in ELID grinding makes it difficult to exactly measure the dimensions of the grinding wheel. Accordingly, it is a problem that the change in the dimension of the grinding wheel with time requires much operator skill in grinding the workpiece to accurate dimensions and shapes.

In the ELID grinding of the prior art, since the formation and removal of the non-conductive film as well as the dissolution of the bond material of the grinding wheel are automatically carried out in the ELID cycle, the change in the dimension of the grinding wheel over time does not necessarily occur at a constant rate. Accordingly, for example, in grinding optical lenses with high accuracy, it is necessary to carry out the grinding by empirically anticipating the dimensional change of the grinding wheel by repeatedly interrupting the grinding operation and also repeatedly measuring the dimensions of the grinding wheel using a micrometer or the like. This requires much labor and a relatively high degree of operator skill and lowers the setup efficiency. It has therefore been desired to provide an in-process means which can measure the dimensions of the grinding wheel during the grinding operation.

In an attempt to meet the above demand, a non-contact method of measurement of the dimensions of the grinding wheel using various means such as laser or a capacitance-type sensors has been proposed and used in certain applications. However, a problem with these means is that the accurate measurement of the dimensions of the grinding wheel is interfered with by the grinding fluid which is often adhered to the surface of the grinding wheel during the ELID grinding operation. In addition, the accurate measurement of the dimensions of the bond portion of the grinding wheel, which actually performs the grinding, is interfered with by the nonconductive film formed on the surface of the grinding wheel during the grinding operation.

The present invention intends to solve the problems mentioned above. That is, it is an object of the present invention to provide a method and an apparatus for grinding with electrolytic dressing which can measure the dimensions of the grinding wheel during the grinding operation without being influenced by the grinding fluid or the nonconductive film and therefore can efficiently carry out a highly accurate grinding operation without a high degree of operator skill.

SUMMARY OF THE INVENTION

In accordance with the above objects, the present invention provides a method of grinding with electrolytic dressing, comprising the steps of: (1) grinding a workpiece with an electrically-conductive grinding wheel; (2) dressing the grinding wheel during the step of grinding by supplying a conductive fluid between an electrode and the grinding wheel and applying a voltage between the electrode and the grinding wheel; (3) measuring a position of a working surface of the grinding wheel using an eddy current sensor arranged in proximity to, but not in contact with the working surface; and (4) controlling the position of the grinding wheel based on the position of the working surface.

Also in accordance with the above objects, the present invention provides an apparatus for grinding a workpiece, comprising: (1) an electrically-conductive grinding wheel having a working surface for grinding a workpiece; (2) an electrode spaced from the grinding wheel; (3) a nozzle disposed to supply electrically-conductive fluid between the electrode and the grinding wheel; (4) a device electrically connected to and for supplying voltage between the grinding wheel and the electrode; (5) an eddy current sensor for measuring a position of the working surface, and disposed in proximity to, but not in contact with the working surface; and (6) a grinding wheel control device operatively connected to the grinding wheel for controlling the position of the grinding wheel based on the position of the working surface.

Also for achieving the objects mentioned above, there is provided, according to the present invention, a method for grinding with electrolytic dressing in which a workpiece is ground by applying a voltage between a conductive grinding wheel and an electrode while supplying conductive fluid therebetween and by grinding the workpiece while electrolytically dressing the grinding wheel, characterized in that the method further comprises the steps of measuring a position of the working surface of the grinding wheel in a non-contact manner using an eddy current sensor arranged in proximity to the working surface of the grinding wheel, and controlling the position of the grinding wheel based on the values measured by the eddy current sensor.

Also according to the present invention, there is provided an apparatus for grinding a workpiece while electrolytically dressing a conductive grinding wheel, comprising a conductive grinding wheel having a contact surface for contacting the workpiece, an electrode opposed to the grinding wheel and spaced a distance therefrom, a nozzle for supplying conductive fluid between the grinding wheel and the electrode, and a device for applying a voltage between the grinding wheel and the electrode, characterized in that the apparatus further comprises an eddy current sensor arranged in proximity to the working surface of the grinding wheel for measuring the position of the grinding wheel in a non-contact manner and a grinding wheel controlling device for controlling the position of the grinding wheel based on the values measured by the eddy current sensor.

The inventor of the present invention discovered the applicability of the eddy current sensor to the measurement of the grinding wheel during its grinding operation (hereinafter referred to as "in-process measurement") which has heretofore been considered impossible due to the presence of the grinding fluid and the nonconductive film. The invention therefore fills a long-felt need in the art. The inventor has also confirmed through various experiments that good results can be obtained by the method and apparatus of the present invention.

FIG. 8 shows the basic principle behind an eddy current sensor. When an alternating current is provided through a coil to generate an alternating magnetic flux, an eddy current will be generated in a conductive plate by the magnetic flux when the conductive plate is placed perpendicularly to the axis of the coil. The smaller the distance "d" between the coil and the conductive plate, the greater the eddy current. Since a magnetic flux generated by the eddy current counteracts the magnetic flux of the coil, the flux and thus also the inductance "L" of the coil is reduced with the generation of an eddy current. Accordingly, it is possible to measure the distance "d" between the coil and the conductive plate without contact by measuring the reduction of the inductance "L". This is the principle of the eddy current sensor.

Such an eddy current sensor is insensitive to water due to the principle of its operation, and thus can be applied to the field of ELID grinding which by definition requires the presence of an electrolyte on the grinding wheel. In addition, since the eddy current sensor can be applied only to a conductive member in which the eddy current can be generated, it is not influenced at all by the nonconductive film formed on the surface of the bond portion of the grinding wheel during ELID grinding. Accordingly, by using the eddy current sensor in ELID grinding, it is possible to measure the dimensions of the bond portion of the grinding wheel which actually carries out the grinding, without being influenced by the nonconductive film on the grinding wheel surface. It has been found through various experiments that the grinding fluid does not exert any influence on the measurement obtained by the eddy current sensor even though the grinding fluid has some electrical conductivity. The present invention is thus achieved on the basis of the above discoveries.

That is, according to the present invention, since the measurement of the position of the working surface of the grinding wheel is carried out in a non-contact manner by the eddy current sensor arranged in proximity to the working surface of the wheel, it is possible to measure the wheel dimensions during the grinding operation without being influenced by the grinding fluid or the nonconductive film. In addition, since the position of the grinding wheel is controlled by a grinding wheel control device based on the values measured by the eddy current sensor, it is possible to efficiently carry out highly accurate grinding without a high degree of operator skill.

Further objects, features, and advantages of the present invention will become apparent from the Detailed Description of the Preferred Embodiments which will follow, when considered together with the attached drawings.

DESCRIPTION OF THE PREFERRED EMBODIMENTS

Preferred embodiments of the present invention will hereinafter be described with reference to the accompanied drawings.

Figure 1:
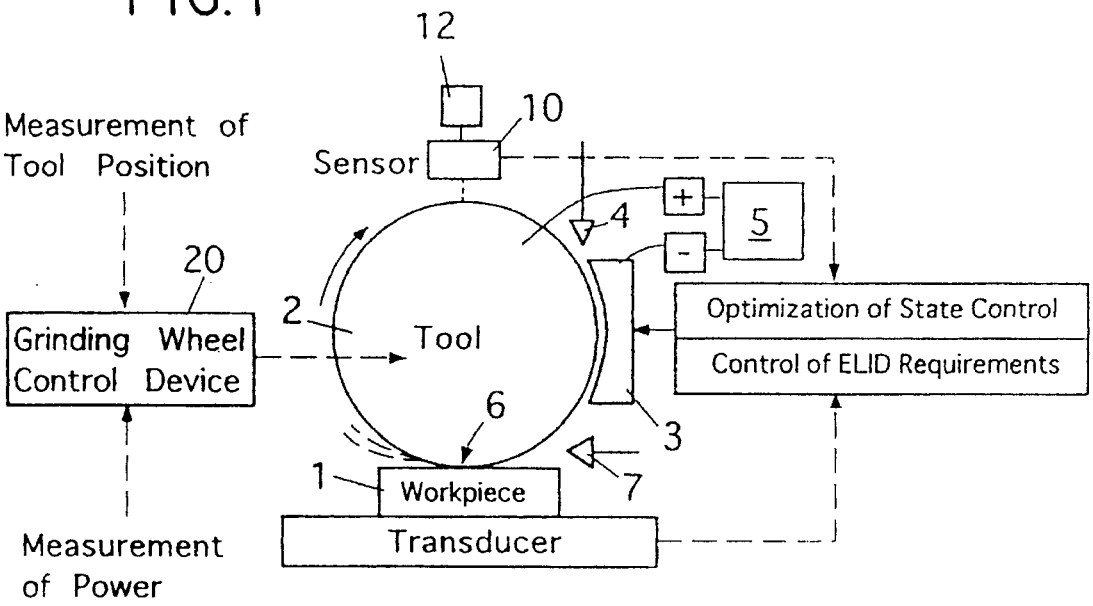
FIG. 1 is a schematic view showing the general construction of an apparatus for grinding with electrolytic dressing according to the present invention.

FIG. 1 is a schematic view showing the general construction of an apparatus for electrolytic dressing according to the present invention. The apparatus comprises a grinding wheel or tool 2 having a contact surface 6 for contacting a workpiece 1, an electrode 3 opposed to the grinding wheel 2 and spaced a distance therefrom, a nozzle 4 for supplying conductive fluid between the grinding wheel 2 and the electrode 3, a nozzle 7 for supplying fluid between the workpiece 1 and contact surface 6, and a device 5 for applying a voltage between the grinding wheel 2 and the electrode 3. The workpiece 1 is adapted to be ground by applying a voltage between the grinding wheel 2 and the electrode 3 while supplying conductive fluid therebetween and by grinding the workpiece 1 while electrolytically dressing the grinding wheel 2. The voltage applying device 5 usually includes an electric power source and a feeder.

The apparatus of the present invention further comprises an eddy current sensor 10 arranged in proximity to the working surface of the grinding wheel 2 for measuring the position of the grinding wheel 2 in a non-contact manner and a grinding wheel controlling device 20 for controlling the position of the grinding wheel 2 based on the values measured by the eddy current sensor 10.

The grinding wheel 2 is a conductive grinding wheel and more preferably a metal bonded grinding wheel using cast iron, cobalt, bronze or other metallic materials. The grinding grains may be diamond, CBN (cubic boron nitride) or other suitable grinding grains.

Figure 8:
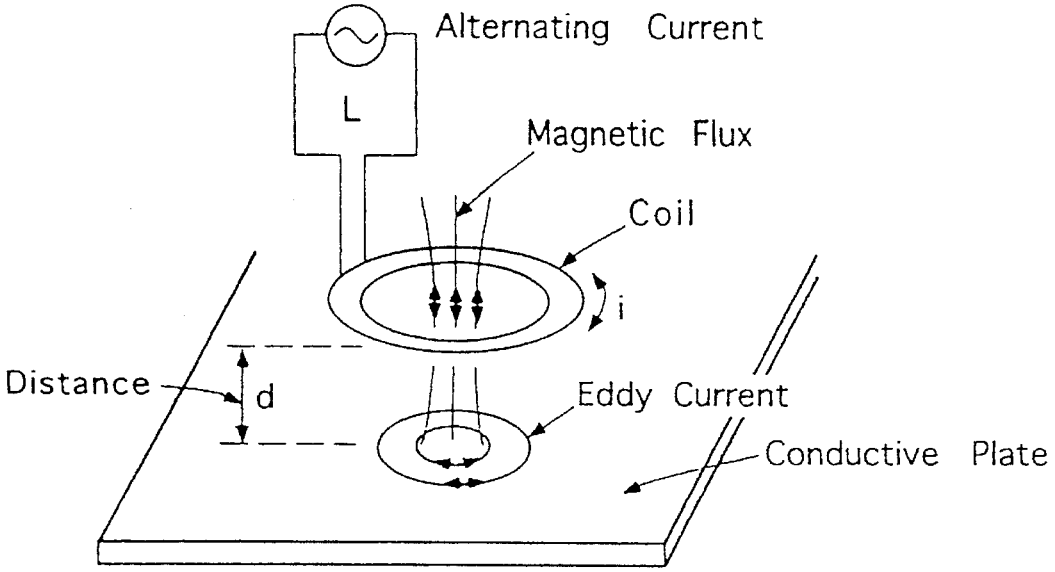
FIG. 8 is a drawing showing the basic principle of an eddy current sensor.

The eddy current sensor 10 is constructed based on the principles shown in FIG. 8, and preferably has a high resolving power of more than 0.4 μm. The eddy current sensor 10 is mounted on a positioning device 12 in proximity to the working surface of the grinding wheel 2 and thus the position of a detecting end (or sensor head) can be finely controlled. The following Table 1 shows the specifications of a preferred embodiment of the sensor head and the positioning device 12.

TABLE 1

SPECIFICATIONS OF IN-PROCESS MEASUREMENT UNIT

| Sensor head | Positioning device |
|---|---|
| Geometry: 5.4 mm<br>Range of measurement: 0.1 mm<br>Output voltage: 0–1 V<br>Responsivity: 3.3 kHz | Geometry: for surface grinding<br>Distance of movement: 10 mm<br>Directions of movement: 2<br>(R: radical direction, W: width direction) |

The output (e.g. voltage) of the eddy current sensor 10 changes based on the type of bond material used to make up the grinding wheel 2, the type of the grinding grains, a filling factor of the grinding grains and the like. It is therefore preferable to previously calibrate the relationship the output of the eddy current sensor 10 and the distance "d" between the working surface of the wheel 2 and the detecting end of the eddy current sensor 10. It is also preferable to store the relationship in a suitable memory means.

The grinding wheel control device 20 is, for example, an NC (numerical control) machine which preferably includes a simulation program for predicting the amount of geometric error from values measured by the eddy current sensor 10, correcting the wheel path to reduce the machining error, and controlling the position of the grinding wheel so that it is not influenced by the change of the geometry of the wheel 2. Table 2 shows specifications of the grinding machine, the grinding wheel, the ELID power source, the workpiece and other components according to preferred embodiments of the present invention.

TABLE 2

SPECIFICATIONS OF EXPERIMENTAL ELID GRINDING SYSTEM

| | |
|---|---|
| 1. Grinding machine | Reciprocal surface grinding machine;<br>Rotary surface grinding machine |
| 2. Grinding wheel | Cast iron bonded diamond grinding wheel;<br>Cobalt bonded diamond grinding wheel;<br>Geometry: Diameter 150 nm-<br>Width 10 mm straight |
| 3. ELID power source | ELID Pulser |
| 4. Workpiece | Carbide alloy |
| 5. Other Components | Grinding fluid: (50 times diluted by service water)<br>Measurements: Compact dynamometer, Universal data processing system |

According to the method of the present invention, the position of the working surface of the grinding wheel 2 is measured by the electrolytically dressing grinding apparatus in a non-contact manner by the eddy current sensor 10 arranged in proximity to the working surface. The position of the grinding wheel 2 is controlled by the grinding wheel control device 20 based on the values measured by the eddy current sensor 10.

According to the method and the apparatus of the present invention, since the measurement of the position of the working surface of the grinding wheel is carried out in a non-contact manner by the eddy current sensor arranged in proximity to the working surface of the wheel, it is possible to measure the wheel dimension during the grinding operation without being influenced by the grinding fluid and the nonconductive film. In addition, since the position of the grinding wheel is controlled by a grinding wheel control device based on the values measured by the eddy current sensor, it is possible to efficiently carry out highly accurate grinding without a high degree of operator skill.

Figure 2:
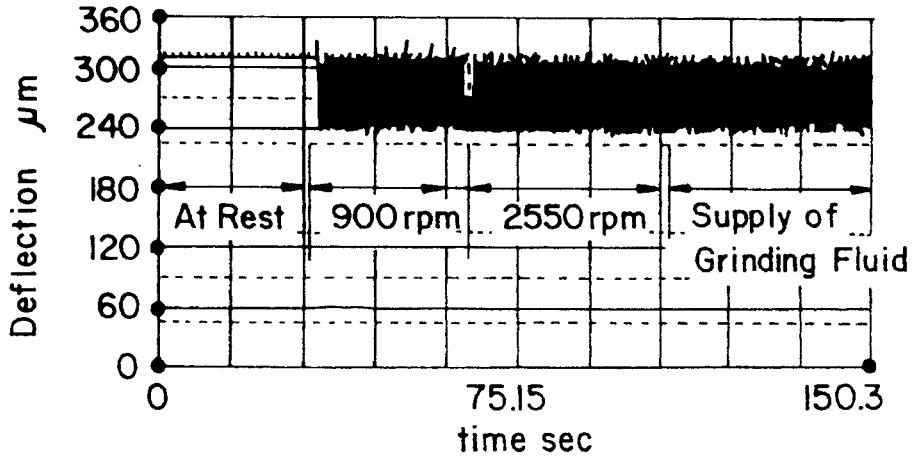
FIG. 2 is a graph showing the measurement of the initial deflection of a cast iron bonded diamond grinding wheel.

FIG. 2 is a graph showing the results of measurement of the initial deflection of a cast iron bonded diamond grinding wheel measured by an apparatus according to the present invention. As shown in FIG. 2, a deflection of about 78 μm of the grinding wheel due to its eccentricity is found at a region beyond 900 rpm of wheel rotation, and no change of the deflection of the wheel is found up to 2550 rpm. In addition, no influence is exerted on the measured values of the wheel deflection, even though grinding fluid is supplied to the workpiece during the measurement. This demonstrates that the present invention is able to perform in-process measurement during an ELID grinding operation requiring grinding fluid.

Figure 3:
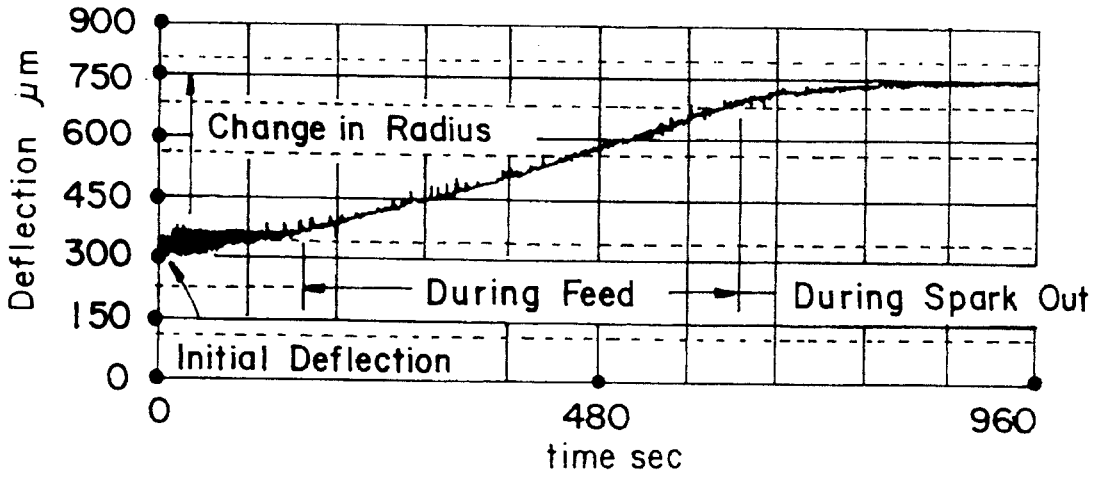
FIG. 3 is a graph showing the in-process measurement of the change in grinding wheel diameter due to the truing of the grinding wheel.

FIG. 3 is a graph showing the results of the in-process measurement of the change in the wheel diameter due to the truing of the grinding wheel using the present apparatus. A change of the initial deflection from about 78 μm to about 11 μm after truing can be measured in-process. It can thus be confirmed that the present invention is able to perform in-process measurement of the truing accuracy.

Figure 4:
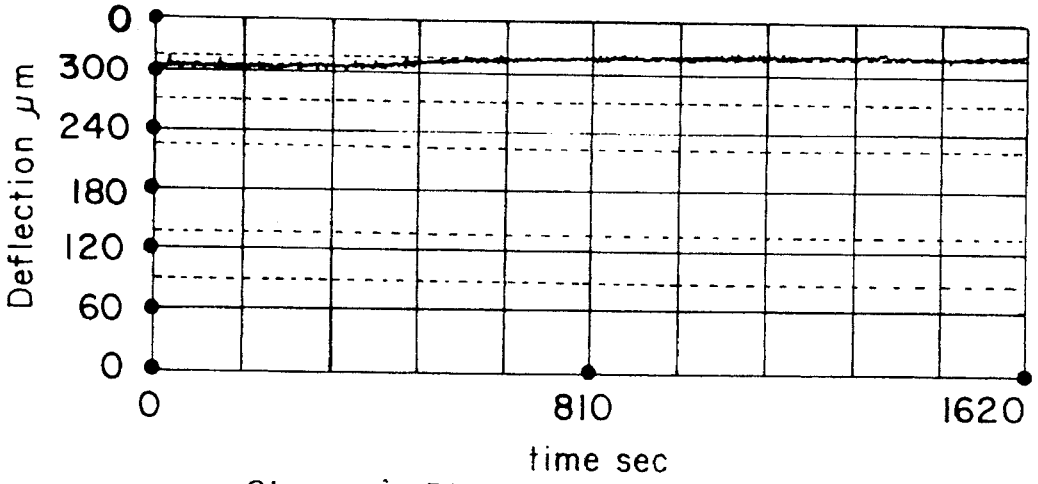
FIG. 4 is a graph showing results of measurement of the change in the diameter of the grinding wheel (i.e., loss of bonding material) during electrolytic dressing.

FIG. 4 is a graph showing results of measurement of the change in the diameter of the grinding wheel (i.e., the degree of the reduction of the bonding material) due to electrolytic dressing after the truing. The change in the wheel diameter of about 10 μm due to the electrolytic dressing over about 30 minutes can be measured in-process.

Figure 5:
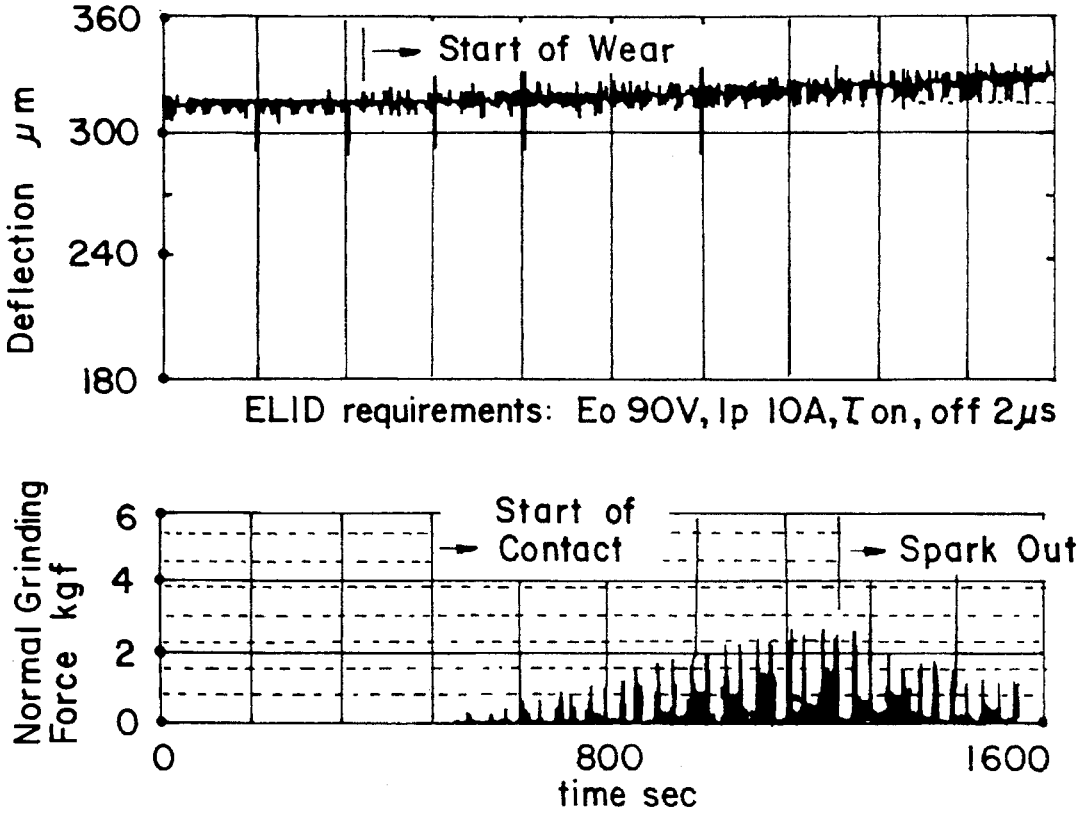
FIG. 5 is a pair of graphs showing in-process measurement, according to an embodiment of the present invention, of the change in the diameter of the grinding wheel due to ELID grinding and the normal grinding force during ELID grinding.

The upper half of FIG. 5 is a graph showing results of in-process measurement of the change in the diameter of the grinding wheel due to ELID grinding. The lower half of FIG. 5 is a graph showing an example of the normal grinding force applied during ELID grinding. As indicated by the "ELID requirements" shown in FIG. 5, the preset voltage Eo and present current Ip between the grinding wheel and the electrode are set at 90 V and 10 A, respectively, and "τ on,off", the preset on and off time of the electric source pulse is 2 μs. In this test, the amount of wheel wear after grinding over about 30 minutes was about 12 μm. This shows that the amount of the wheel wear becomes large despite grinding for a short time of only about 30 minutes when the in-process measurement of the present invention is not carried out. The amount of the wheel wear is slightly larger than that caused only after the electrolysis. The "start of wear" in the upper half of FIG. 5, which indicates the start of electrolysis of the grinding wheel, begins earlier than the "start of contact" in the lower half of FIG. 5, which indicates the start of actual contact between the grinding wheel and the workpiece. This shows that the nonconductive film becomes thin owing to its contact (commencing at time "0") with the workpiece and that the wear of the bonding portion owing to the above mentioned ELID cycle has begun.

Figure 6:
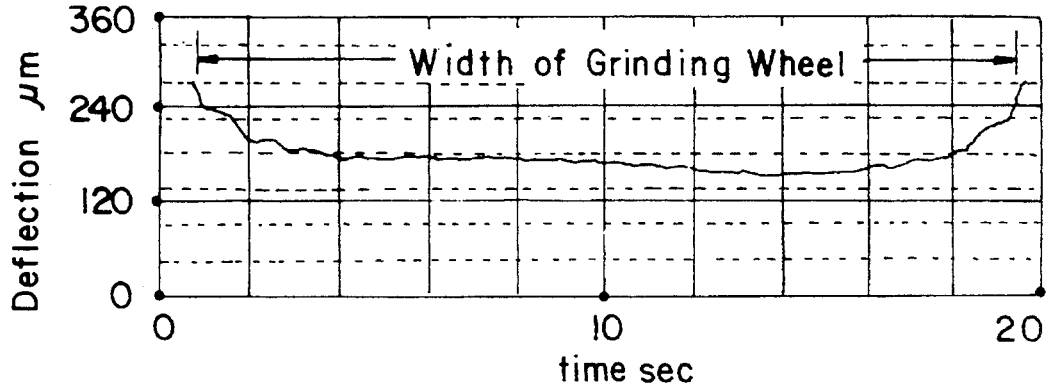
FIG. 6 is a graph showing an example of measurement of a cross-sectional configuration of the bonded grinding wheel, according to an embodiment of the present invention, measured by moving the sensor along the width of the grinding wheel.
Figure 7:
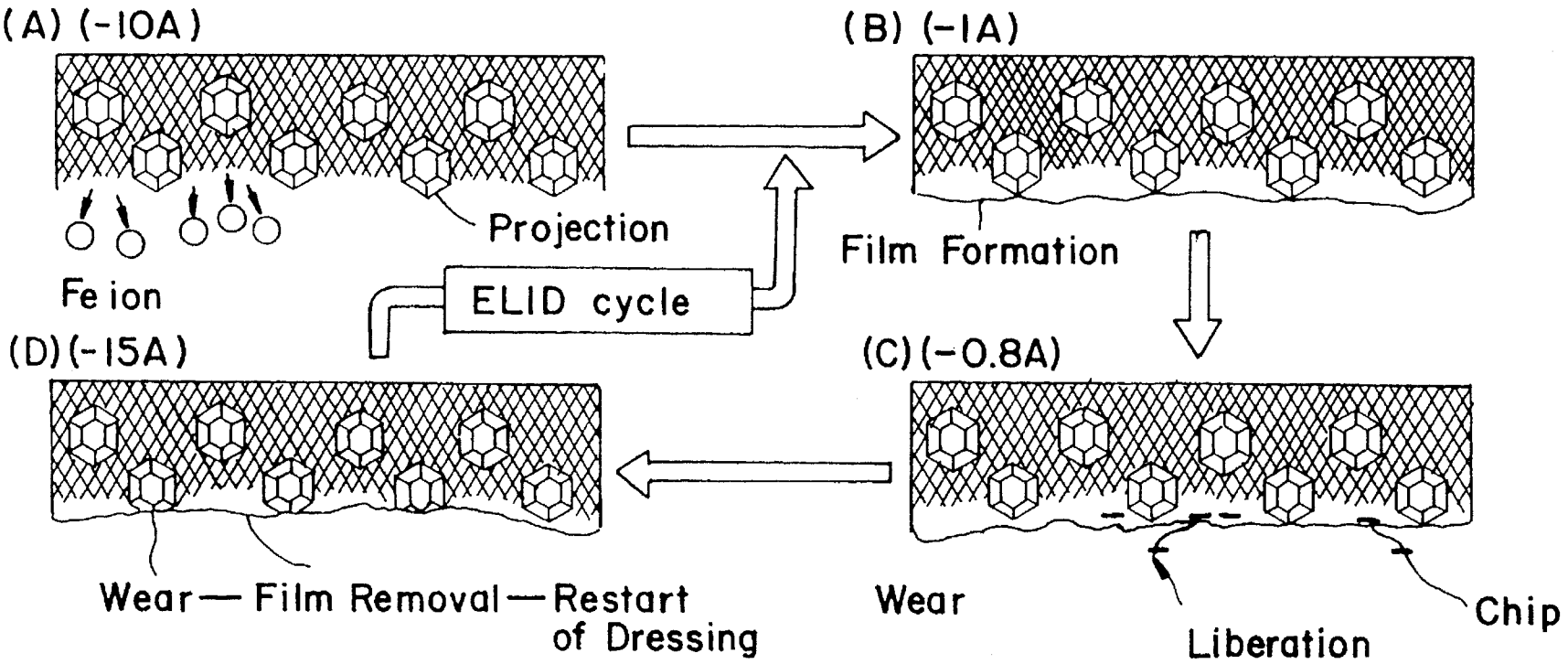
FIG. 7 PRIOR ART
FIG. 7 (PRIOR ART) is a schematic illustration showing the ELID cycle of the ELID grinding method.

FIG. 6 shows an example of the measurement of the cross-sectional of the bonded grinding wheel made by moving the sensor along the width of the grinding wheel. FIG. 6 shows that the sensor can exactly detect the configuration of the wheel surface.

The grinding wheel used in the test was a cast iron bonded diamond grinding wheel. However, the in-process measurement can be similarly applied to a cobalt bonded diamond grinding wheel.

The present invention is not limited only to the embodiments described above and a wide range of changes and modifications can be made to the above preferred embodiment while remaining within the scope of the appended claims.

For example, although the resolving power of presently available eddy current sensors is about 0.4 μm, it is possible to carry out generally more accurate ELID grinding by using a more accurate machine and by complementing the values measured by the sensor. In addition, an appropriate means for controlling the electrolysis of the grinding wheel may be combined with the eddy current sensor. It is also possible to arrange two eddy current sensors orthogonally to or slightly offset from each other in order to more exactly determine the position of the grinding wheel from values measured by the two sensors. Furthermore, the present invention may also be applied to a grinding wheel supported for example by a dynamic pressure bearing which shifts the center of the wheel to different positions when the wheel is being operated and when the wheel is not being operated. The present invention may also be applied to correct the amount of elastic deformation of the machine caused during the ELID grinding. Furthermore, the geometry of the grinding wheel is not limited to cylindrical and the present invention can be applied to a cup shaped grinding wheel, a lapping wheel and other kinds of grinding wheels.

As described above, the inventor of the present invention discovered the applicability of the eddy current sensor to the measurement of the grinding wheel during its grinding operation ("in-process measurement"), for which there was a long-felt need, and which has heretofore been believed to be impossible due to the presence of the grinding fluid and the nonconductive film. The inventor has also confirmed through various experiments that good results can be obtained by the present method and apparatus. An eddy current sensor according to the present invention is not influenced by water due to the principle by which it is constructed and thus can be applied in the field of ELID grinding which by definition requires the use of an electrolyte. In addition, since the eddy current sensor can be applied only to a conductive member in which the eddy current is formed, the sensor is not influenced at all by the nonconductive film formed on the surface of the bonding material portion of the grinding wheel during the ELID grinding. Accordingly, according to the present invention, it is possible to measure the dimensions of the bonding material portion of the grinding wheel practically and to carry out grinding without being influenced by the nonconductive film on the grinding wheel surface. It has been found through various experiments that the grinding fluid does not exert any influence on the measurement obtained by the eddy current sensor although the grinding fluid has electrical conductivity. The present invention is thus achieved on the basis of this new discovery.

As stated above, according to the method and the apparatus-of the present invention, it is possible to measure the wheel dimension during the grinding operation without any influence from the grinding fluid or the nonconductive film. It is also possible to efficiently carry out highly-accurate grinding without a high degree of operator skill.

Although the present invention has been illustrated with respect to several preferred embodiments, one of the ordinary skill in the art will recognize that modifications and improvements can be made while remaining within the scope and spirit of the present invention. The scope of the present invention is determined solely by the appended claims.

What is claimed is:

1. A method of grinding with electrolytic dressing, comprising the steps of:

grinding a workpiece with an electrically-conductive grinding wheel;

dressing the grinding wheel by supplying a conductive fluid between an electrode and said grinding wheel and applying a voltage between the electrode and the grinding wheel;

directly measuring a position of a working surface of the grinding wheel using an eddy current sensor arranged in proximity to, but not in contact with the working surface; and controlling the position of the grinding wheel based on the position of the working surface.

2. A method according to claim 1, further comprising the step of controlling the position of said eddy current sensor.

3. A method according to claim 1, wherein said step of measuring comprises measuring a profile across a width of said grinding wheel.

4. A method according to claim 1, further comprising the step of measuring the position of said working surface with a second eddy current sensor positioned offset from said eddy current sensor.

5. A method according to claim 1, further comprising the step of shifting said grinding wheel from a first non-operative position to a second operative position for grinding.

6. A method according to claim 1, wherein the step of controlling further comprises the step of calculating an amount of error to the workpiece caused by a given position of said working surface and correcting said position of the grinding wheel to compensate for the error.

7. A method according to claim 1, further comprising the step of controlling the dressing of the grinding wheel based on the position of the working surface measured by said eddy current sensor.

8. An apparatus for grinding a workpiece, comprising:

an electrically-conductive grinding wheel having a working surface for grinding a workpiece;

an electrode spaced from the grinding wheel;

a nozzle disposed to supply electrically-conductive fluid between the electrode and the grinding wheel;

a device electrically connected to and for supplying voltage between the grinding wheel and the electrode;

an eddy current sensor positioned for directly measuring a position of the working surface, and disposed in proximity to, but not in contact with the working surface;

a grinding wheel control device operatively connected to the grinding wheel for controlling the position of the grinding wheel based on the position of the working surface.

9. An apparatus according to claim 8, wherein said device for supplying voltage comprises a power source and a feeder.

10. An apparatus according to claim 8, further comprising a second eddy current sensor for directly measuring a position of the working surface, disposed in proximity to, but not in contact with the working surface, and disposed offset from said eddy current sensor.

11. An apparatus according to claim 8, further comprising means, connected to the sensor, for adjusting the position of the sensor.

12. An apparatus according to claim 8, wherein the grinding wheel is a cast iron bonded diamond grinding wheel.

13. An apparatus according to claim 8, wherein the grinding wheel is a cobalt bonded diamond grinding wheel.

14. A method of grinding with electrolytic dressing, comprising the steps of:

grinding a work piece with an electrically-conductive grinding wheel;

dressing the grinding wheel while grinding by supplying a conductive fluid between an electrode and the grinding wheel and applying a voltage between the electrode and the grinding wheel;

directly measuring a position of a working surface of the grinding wheel, while grinding, using an eddy current sensor arranged in proximity to, but not in contact with the working surface; and controlling the position of the grinding wheel based on the position of the working surface.

15. A method according to claim 14, whereby, during said step of dressing the grinding wheel, the grinding wheel is cyclically electrolytically dressed and covered with a non-conductive film.

* * * * *